US008133068B2

(12) United States Patent
Suttner et al.

(10) Patent No.: US 8,133,068 B2
(45) Date of Patent: Mar. 13, 2012

(54) CURRENT CONNECTION APPARATUS FOR TANKS

(75) Inventors: Juergen Suttner, Marklkofen (DE); Johann Bernauer, Tiefenbach (DE)

(73) Assignee: Schott AG, Mainz (DE)

( * ) Notice: Subject to any disclaimer, the term of this patent is extended or adjusted under 35 U.S.C. 154(b) by 88 days.

(21) Appl. No.: 12/660,896

(22) Filed: Mar. 5, 2010

(65) Prior Publication Data

US 2010/0227492 A1 Sep. 9, 2010

(30) Foreign Application Priority Data

Mar. 5, 2009 (DE) ..... 10 2009 014 334

(51) Int. Cl.
*H01R 13/52* (2006.01)

(52) U.S. Cl. ..... 439/271; 439/564

(58) Field of Classification Search ..... 439/271, 439/564

See application file for complete search history.

(56) References Cited

U.S. PATENT DOCUMENTS

| | | | | |
|---|---|---|---|---|
| 4,573,757 | A * | 3/1986 | Cochran et al. | 439/271 |
| 5,727,421 | A * | 3/1998 | Murphy | 73/304 R |
| 6,994,589 | B2 * | 2/2006 | Schliese | 439/587 |
| 7,341,484 | B2 * | 3/2008 | Yamamoto | 439/587 |

FOREIGN PATENT DOCUMENTS

| | | |
|---|---|---|
| DE | 8902403.6 | 6/1989 |
| DE | 602005001035 | 1/2008 |
| WO | WO2008/063381 | 5/2008 |

OTHER PUBLICATIONS

Office Action dated Aug. 1, 2011 corresponding to Chinese Patent Application No. 201010130344.6.

Office Action dated Oct. 29, 2009 for corresponding German Patent Application No. 10 2009 014 334.3-34.

* cited by examiner

*Primary Examiner* — Hien Vu

(74) *Attorney, Agent, or Firm* — Ohlandt, Greeley, Ruggiero & Perle, LLP

(57) ABSTRACT

A current connection apparatus for a pressure tank is provided. The current connection apparatus includes a tank flange mounted on a tank and an opening that leads into the tank. Electrical connection cables are installed in this opening for connecting with an external electrical apparatus. An electrical lead having one or more conductors, which are electrically insulated relative to a metal flange, and a protective casing. The electrical lead is disposed between the tank flange and the protective casing and is tightly fastened to the tank flange. A plug body, which has plug elements corresponding to conductors of electrical lead, is inserted into the tank opening in the tank flange. The protective casing also has a plug body inserted therein, where the plug body has plug elements.

13 Claims, 3 Drawing Sheets

CURRENT CONNECTION APPARATUS FOR TANKS

CROSS REFERENCE TO RELATED APPLICATIONS

This application claims benefit under 35 U.S.C. §119(a) of German Patent Application No. 10 2009 014 334.3, filed Mar. 5, 2009, the entire contents of which are incorporated herein by reference.

BACKGROUND OF THE INVENTION

1. Field of the Invention

In general, the invention relates to current connection devices, and in particular, the invention relates to producing a current connection from the outside into a tank. In tanks for storing or transporting combustible hazardous materials, it is often necessary to introduce a high electrical power into the tank. For example, submergible pumps disposed inside tanks are utilized in plants for storing and transporting liquefied natural gas.

2. Description of Related Art

In order to introduce the power necessary for the pumps to inside the tank, connection apparatuses with gas-tight electrical leads are used. The cables that are to be connected are usually screwed with cable lugs to the conductors of the power leads. Plants of this type, of course, are often set up or maintained by personnel with undefined basic qualifications. If a lead is to be changed or re-introduced after a maintenance operation, there is the danger that when the cables are connected, mechanical damage or errors may occur, such as, e.g., mixing up phases and in this way, possibly causing short circuits and a defective tight connection. In the case of combustible hazardous materials, it is precisely these types of errors that may have fatal consequences. In addition, the connection procedure is very time-consuming.

BRIEF SUMMARY OF THE INVENTION

The object of the invention is thus to reduce labor expense in assembling current connection apparatuses and to increase operating safety. This object is accomplished by the subject of the independent claims. Advantageous embodiments and enhancements of the invention are indicated in the dependent claims.

Accordingly, the invention provides a current connection apparatus for a tank, in particular a pressure tank, which comprises a flange mounted on the tank, called a tank flange in the following, this flange having an opening leading into the tank, and electrical connection cables are installed in this opening for connecting to an external electrical apparatus, an electrical lead having a metal flange, which has at least one opening and is tightly packed by an insulation body in the axial direction, and at least one conductor which is electrically insulated relative to the flange is disposed in this opening, whereby the electrical lead overall has several conductors electrically insulated relative to the flange, as well as a protective casing.

In this case, the lead is disposed between the flange mounted on the tank and the protective casing for the outgoing cable, and is tightly fastened to the tank flange. A plug body, to which the inner supply cable is connected and which has plug elements corresponding to the conductors of the electrical lead, is inserted in the tank flange or into the tank opening in the tank flange, so that by attaching the lead onto the tank flange, the connection cables are electrically contacted with the conductors of the electrical lead.

The protective casing also has a plug body with plug elements inserted therein, to which is connected the outgoing cable and which electrically makes contact with the conductors of the electrical lead by placing the protective casing on the flange.

By means of the plug body which is inserted in the opening of the tank flange and which has plug elements that electrically contact the connection cables on the tank side connected to the plug elements when the electrical lead is attached, the expenditure for the connection by cable lugs is avoided while simultaneously avoiding the danger of an erroneous hookup of the connection cables. The same also applies to the assembly of the protective casing. An error during the assembly operation for the current connection apparatus is thus practically excluded.

The tank flange can be designed, for example, as a welding neck flange.

In order to obtain a tight connection between the electrical lead and the tank flange, a suitable sealing surface must be provided on the flange of the electrical lead. The seal can be made, for example, by an O-ring, special tank gaskets or a metal ring seal. A tight connection between the protective casing and the metal flange of the electrical lead is also particularly preferably provided. This tight connection can also be made by an O-ring, a metal gasket or other plastic, graphite or graphite-metal gasket matched to the medium.

The plug elements in the plug bodies are preferably formed as receptacles in which the corresponding conductors of the electrical lead make contact when mounted. In this case, the projecting ends of the conductors of the electrical lead are formed as solid rods.

The electrical lead, in addition, preferably has tube-shaped insulating elements surrounding the conductors at least on one side, and the inner walls of these elements are radially distanced from the conductors, at least in the plug-in region of the receptacle. In this way, the insulating paths are lengthened in order to increase the dielectric strength and to reduce leakage currents. The corresponding plug body can then have plug elements in the form of receptacles, which penetrate into the tube-shaped insulating elements and then are surrounded by the tube-shaped insulating elements in the state when contacted by the conductors. In order to further improve the insulation, the receptacles can be already insulated with insulating pipes or insulating flexible tubings, which project into the corresponding tube-shaped insulating elements in the assembled state.

In an enhancement of the invention, the tube-shaped insulating elements can also be mounted, in particular, directly on the insulation body and bonded or molded in one piece, so that the conductor associated with it is completely surrounded by electrically insulating material, at least in the region of the outlet from the insulation body.

In order to connect the tube-shaped insulation elements with the insulation bodies in the flange, it is additionally favorable for this purpose to provide at least one spring element, which permanently presses the tube-shaped insulating elements onto the insulation body of the assigned conductor. This spring element may be a pressing plate, for example, which is placed under bending stress by connecting it with the flange. Such a plate thus acts to a certain extent as a leaf spring. Other possibilities also include tension springs, spring washers or flat spiral springs, which exercise a spring force on the tube-shaped insulating elements in the direction onto the one or more insulation bodies in the flange. By means of the tube-shaped insulating elements pressed by spring force, critical leakage currents are avoided or at least reduced along the support surface of the tube-shaped insulating element on the insulation body, even after aging and stresses due to changing temperatures. Also, pressing by means of a spring force counteracts a possible gradual relaxation of the connection, which increases the long-term stability of the dielectric strength.

Preferred materials for the plug bodies used on the tank side or inserted into the opening of the tank flange are polytetrafluoroethylene ("PTFE"), such as TEFLON, ceramics, fiber-reinforced epoxy resin or glass. These materials are outstanding not only with respect to their insulation properties, but are also suitable for use at both high and low temperatures. The latter case is a particularly issue in tanks for liquefied natural gas. Other materials, such as, e.g., resin-impregnated paper or various plastics, such as, for example, polyethylene are also considered for plug bodies in the protective casing.

The electrical lead is preferably screwed with the tank flange by means of bolts and nuts with the use of a suitable gasket or washer. In this way, on the one hand, a secure connection is attained and, on the other hand, a high pressing force is achieved for producing a secure seal. In particular, an interrupted screw connection can also be provided, which simultaneously connects tank flange, electrical lead and protective casing with one another, in order to simplify the assembly procedure.

The current connection apparatus is particularly suitable as a heavy-current power connection apparatus. In order to transfer the necessary power, the conductors of the electrical lead for this purpose preferably have a diameter of at least five millimeters. The application of this technique is also possible in the case of signal leads.

Just as in the case of safety tanks for storing or transporting hazardous material, the operating safety can be considerably improved if the electrical lead has two lead units tightly joined in the axial direction, whereby each of the parts has at least one insulating body and several conductors, whereby corresponding conductors of the parts are electrically connected to one another. Thus, e.g., if one of the insulation bodies breaks in the part of the electrical lead on the tank side, then a leakage of hazardous substance is prevented by the tight connection relative to the other part.

A particularly high operating safety is achieved by an insulating body in the electrical lead in the form of a glass seal, due to its high stability and insensitivity to temperature. Ceramic insulating bodies, however, are also suitable.

A particular advantage of the current connection apparatus according to the invention is also that it can be constructed for the most part or even completely modular. Prefabricated subassemblies can be finished in parallel, pre-mounted and then be very simply assembled on site, even by less qualified personnel. In the case of previously common current connection apparatuses for tanks, almost all finishing steps were conducted on the actual current lead itself. Thus, only one work group or a limited number of persons were able to work on the finishing operations of the connection apparatus. The above-described modular construction, in contrast, makes possible assembly operations in parallel.

Two subassemblies are formed by the connection parts with the plug bodies, or by the plug bodies themselves. The lead forms another subassembly. If, as preferred, the lead is constructed in two parts with lead units tightly joined in the axial direction, each of the units of the lead can also form a subassembly. In this case, it is also favorable to provide a subassembly with electrical connections, which interconnects the conductors of the lead units that correspond to one another. The conductors, for example, in the form of double receptacles, may be installed insulated from one another for this purpose in the subassembly. To this end, the subassembly may have an insulating body, in which the electrical connections are fastened. For finishing the lead, the subassembly having the electrical connections can then be attached onto the conductors of one of the lead units and then the other lead unit can be plugged in, so that when the parts are assembled, the conductors of the lead units that correspond to one another can also be electrically contacted with one another simultaneously.

Therefore, according to an enhancement of the invention, at least one prefabricated subassembly having the plug body on the connection side and at least one other subassembly having one or more leads are provided. Correspondingly, a production process results therefrom, in which the above-named subassemblies are prefabricated and the current connection apparatus is finished by combining these subassemblies.

In particular, the finishing method can be based on producing a current connection apparatus according to the present disclosure, wherein at least the plug body on the connection side, the one removed from the tank flange, and the lead are each components of prefabricated subassemblies and these subassemblies are prefabricated correspondingly and the current connection apparatus is finished by attaching the subassembly having the lead to another subassembly having the protective casing and the plug element fastened therein in operation-ready form.

The invention will be explained in detail below based on embodiment examples with reference to the appended figures. Here, the same reference numbers refer to the same or corresponding elements.

DETAILED DESCRIPTION OF THE INVENTION

Figure 1:
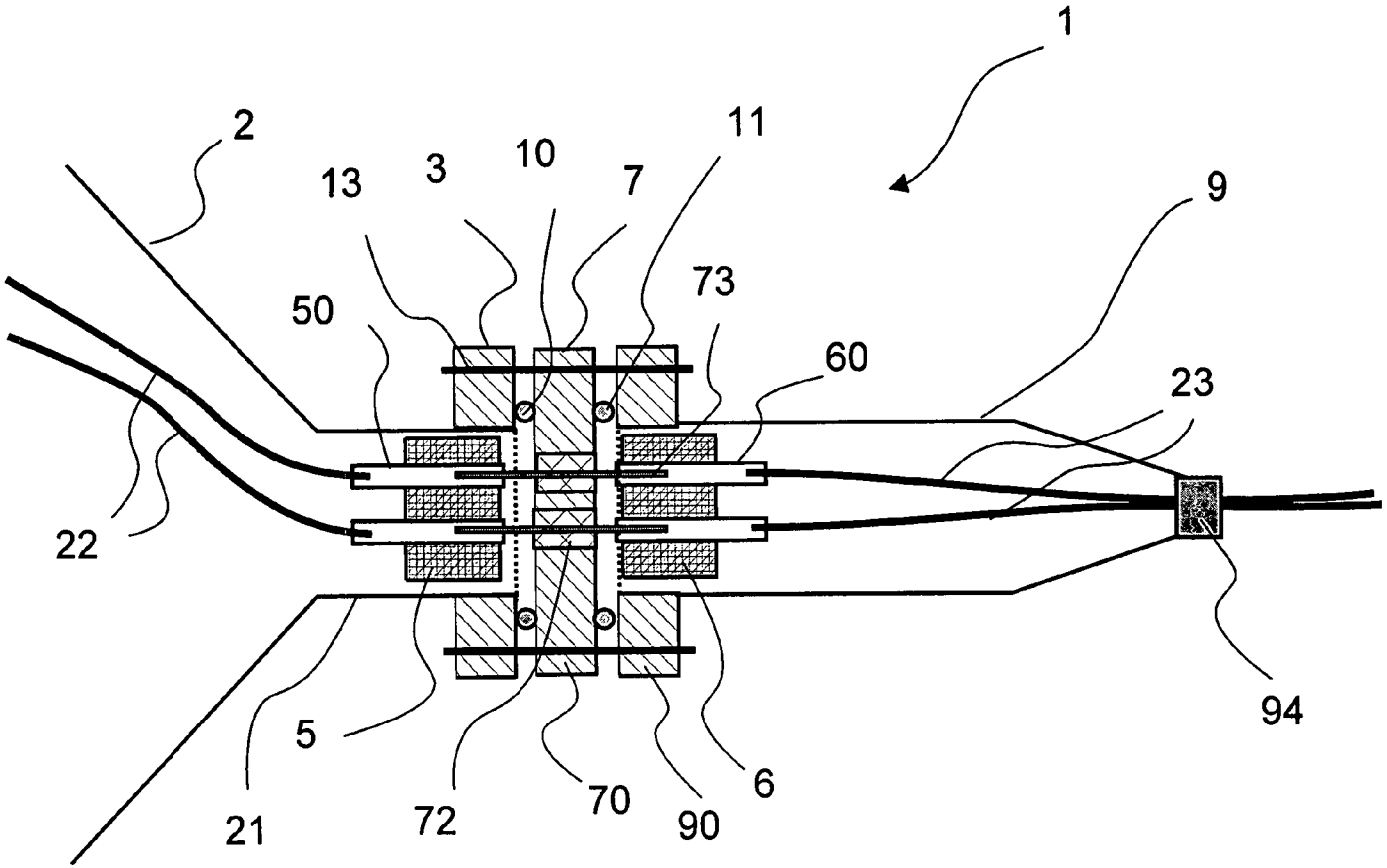
FIG. 1 shows a schematic cross section through a current connection apparatus.

FIG. 1 schematically shows a cross-sectional view of the current connection apparatus in basic form.

The current connection apparatus designated by reference number 1 is mounted as a whole on a pipe connection 21 of a tank 2. Tank 2 may be, for example, a tank for storing and/or transporting liquefied natural gas or petroleum products. Among other things, a submergible pump for transporting the tank content can be connected to current connection apparatus 1 inside the tank.

Current connection apparatus 1 comprises a welding neck flange 3 which is welded to pipe connection 21 of tank 2 and which has an opening leading into tank 2 or into the pipe connection, and electrical connection cables 22 for connecting to an external electrical current supply device, for example, a switching unit or control unit for supplying the submergible pump connected to electrical connection cables 22, are installed in this opening.

An electrical lead 7 is attached to a metal flange 70 on welding neck flange 3. A tight connection between welding neck flange 3 and electrical lead 7 is produced by means of a gasket 10 disposed between metal flange 70 of the electrical lead and welding neck flange 3. Electrical lead 7 or its metal flange 70 has several openings extending in the axial direction and filled with insulating bodies, these openings being filled by insulating bodies 72 in a sealing and pressure-resistant manner. In the example shown in FIG. 1, a conductor 73 is disposed in each of insulating bodies 72, the ends of the conductor projecting on both sides of electrical lead 7 in the axial direction. By means of insulating bodies 72, conductors 73 are electrically insulated relative to metal flange 70, or to the edge of the openings filled by insulating body 72.

A protective casing 9 with flange 90 is attached to electrical lead 7, so that lead 7 is disposed between welding neck flange 3 and protective casing 9. External connection cables 23 are introduced into protective casing 9. In the example shown in FIG. 1, a strain relief 94 for external connection cables 23 is additionally provided on protective casing 9.

A plug body 5 is inserted into the tank opening in welding neck flange 3 and fastened therein, this body having plug elements in the form of receptacles 50 corresponding to conductors 73 of electrical lead 7, so that by attaching electrical lead 7 onto welding neck flange 3, conductors 73 engage in the receptacles and in this way, connection cables 22 in the tank are electrically contacted with conductors 73 of electrical lead 7.

Protective casing 9 also has a plug body 6 inserted therein, this plug body having plug elements in the form of receptacles 60, which are brought into contact with conductors 73 of electrical lead 7 by attaching protective casing 9 onto the flange of electrical lead 7, and thus connect external connection cables 23 with conductors 73.

Preferably, a gasket 11 is also installed between flanges 70 and 90 of electrical lead 7 and protective casing 9 in order to prevent, among other things, the intake of water, moisture and dust into protective casing 9.

In order to simplify the assembly procedure and also to obtain compact outer dimensions, flanges 70 and 90 are screwed to welding neck flange 3 by means of a continuous screw connection 13.

Figure 2:
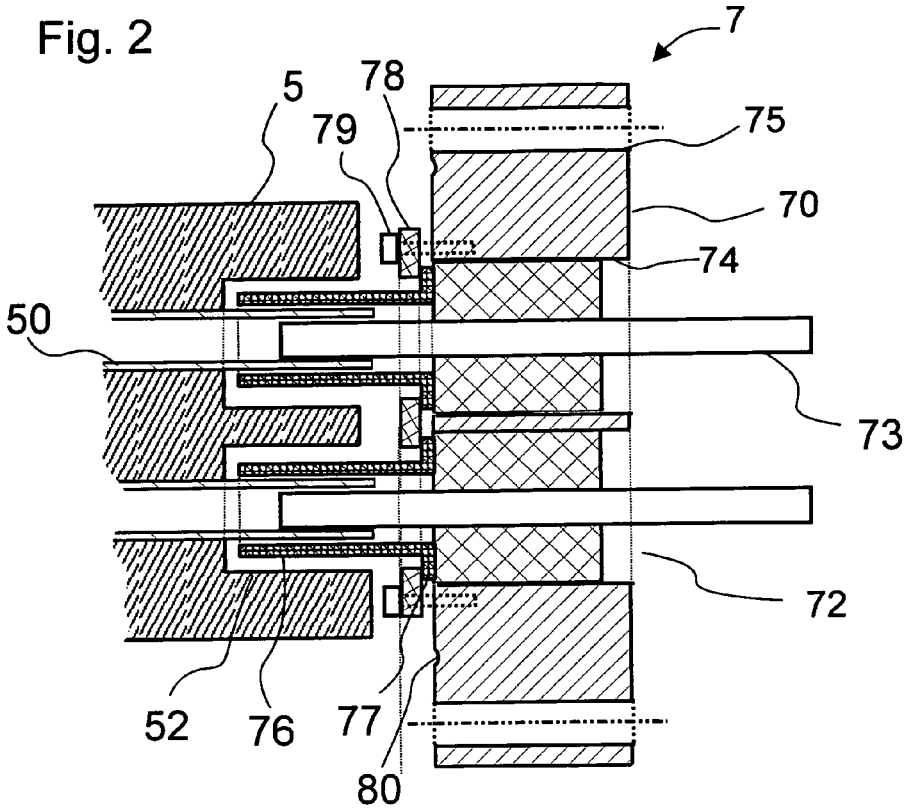
FIG. 2 shows details of the electrical lead and a corresponding plug body.

FIG. 2 shows details of one example of embodiment of a current connection apparatus 1 according to the invention. Electrical lead 7 and plug body 5 attached on the tank side in pipe connection 21 or fastened in welding neck flange 3 are shown.

Electrical lead 7 additionally has tube-shaped insulating elements 76 surrounding conductors 73, and the inner wall of these elements is radially distanced from conductors 73. In the example shown in FIG. 2, each of the tube-shaped insulating elements 76 has a protruding foot 77. A plate 78 with openings for tube-shaped insulating elements 76 is attached to foot 77 and screwed with flange 70 by means of screw connections 79, so that the tube-shaped insulating elements 76 are fixed in place. In this way, feet 77 are pressed, in particular, directly onto insulation bodies 72.

Pressing by means of a plate 78 makes possible a high pressing pressure in the region of the contacting surfaces of insulation body 72 and insulating element 76. In this way, the plate particularly provides a certain spring action, which opposes a possible relaxation of the connection over time or reduces a gradual release of the pressing force. In general, without limitation to the example shown in FIG. 2, in an enhancement of the invention, at least one spring element is provided, by means of which the tube-shaped insulating elements are pressed onto the insulation body of the lead. Due to the pressing of insulating elements 76, critical leakage currents at the interface between insulation body in flange 70 and insulating elements 76 are avoided.

Figure 3:
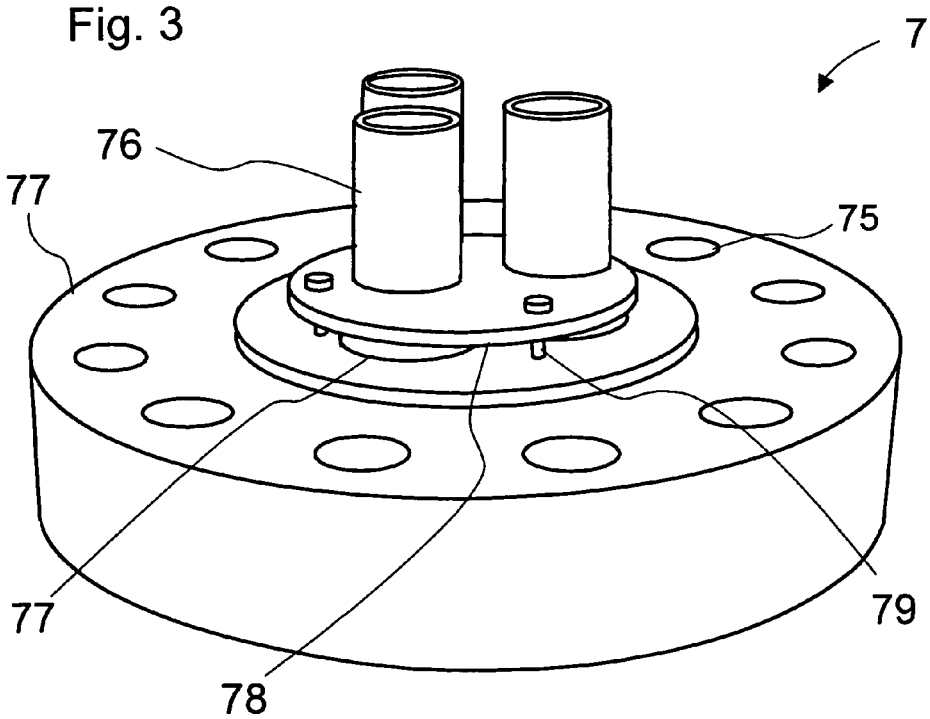
FIG. 3 shows a perspective view of an electrical lead.

For this purpose, FIG. 3 shows in addition a perspective view of an electrical lead 7 with three conductors and correspondingly three fixed, tube-shaped insulating elements 76. By means of screw connections 79, plate 78 is placed under a bending stress overall like a leaf spring, and this stress in transferred to feet 77 of tube-shaped insulating elements 76.

A high-insulating, temperature-stable plastic, such as TEFLON, is preferred in general as the material for tube-shaped insulating elements 76. The same is true also for plug body 5. Materials such as glass or ceramics are also suitable for plug body 5. A suitable material for plug body 6 on the connection side in protective casing 9 is epoxy resin and resin-impregnated paper, in addition.

Plug body 5 has openings 52, into which project tube-shaped insulating elements 76. In addition, receptacles 50 of the plug body are fixed in place centrally inside openings 52, and these receptacles in turn connect over conductors 73 of the electrical lead and produce an electrical contact with conductors 73. Very long leakage paths are achieved by insulating elements 76 in combination with the corresponding openings 52, which in turn increases the dielectric strength. The insulating capacity can be further improved by an additional insulation of the receptacles.

Also, the other side of electrical lead 7 and plug body 6 in the protective casing are preferably configured as shown on the basis of FIG. 2. For the purpose of easy comprehension, the tube-shaped insulating elements on the other side of the electrical lead and the plug body 6 of protective casing 9 belonging thereto are not shown, however, in FIG. 2.

In addition, a sealing surface 80 on which gasket 10 which is shown in FIG. 1 is applied, is shown in FIG. 2, as well as through boreholes 75 at the edge of flange 70 of electrical lead 7, through which screw connections 13 are inserted for the assembly.

In the embodiment examples that were shown previously, a conductor was disposed each time in an axial opening of the flange of the electrical lead. In fact, for the current supply, in general, several conductors are provided, but of course several conductors can also be electrically insulated relative to the flange by a common insulating body.

Figure 4:
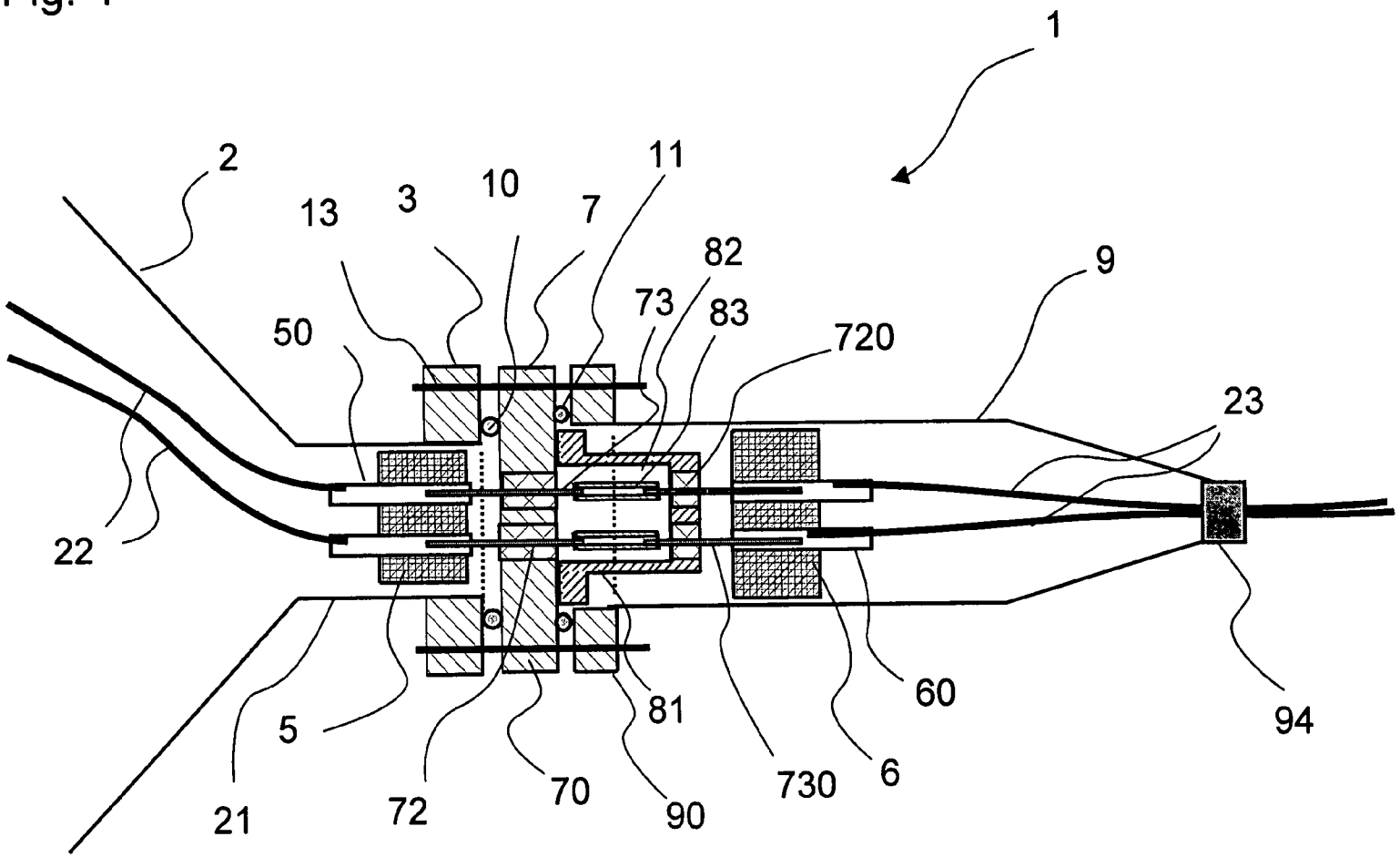
FIG. 4 shows a two-part electrical lead.

FIG. 4 shows a preferred variant and an enhancement of the example shown in FIG. 1. A two-part electrical lead 7 is provided in this variant. Here, electrical lead 7 comprises a flange 70 with insulated conductors 73. Another part 81 in the form of a metal body is additionally attached onto flange 70. The additional part is shaped like a cap in the example shown in FIG. 4. Of course, however, alternative forms are also possible. In additional part 81, conductors 730, which are electrically insulated opposite additional part 81 by insulating bodies, are also preferably disposed axially aligned with conductors 73.

A hermetically sealed intermediate space 82 is formed between flange 70 and additional part 81 of the lead. The corresponding conductors 73, 730 in flange 70 and additional part 81 make contact with one another and are insulated by means of insulating tubes in this intermediate space. Double-sided receptacles 83, for example, as shown in FIG. 4, can be used for this purpose.

This variant has the advantage that if one of the insulating bodies 72, 720 that are made tight and pressure-resistant should fail relative to the seal, the current lead additionally seals tank 2 in a gas-tight manner, since in this case, gas or liquid can penetrate at most into intermediate space 82 due to the leak that arises. An examining of the intermediate space for an increase or a drop in pressure makes possible a constant monitoring of the tightness.

As it is shown schematically in FIGS. 1 and 4, the current connection apparatus which is pre-assembled beforehand can then be assembled at the site of installation in a particularly advantageous manner by connecting prefabricated subassemblies very simply and quickly, in particular finishing the assembly by parallel operations. In this case, lead 7 forms a prefabricated subassembly. Another subassembly contains the plug body 6 on the connection side.

The current connection apparatus is then finished by attaching the subassembly to electrical lead 7 and another subassembly to plug body 6. Protective casing 9 can still preferably belong to the subassembly having plug body 6. In this way, the electrical contacting is carried out simultaneously when components 7 and 9 are connected with flange 3.

In the case of the two-part electrical lead 7, which is shown in FIG. 4 by way of example, the two parts 70 and 81 can also form in common a subassembly. In this case, the two parts 70, 81 are pre-assembled by contacting conductors 73, 730 by means of receptacles 83. In addition, the conducting connections between conductors 73, 730, which are formed by receptacles in the example shown in FIG. 4, can also be designed as a subassembly. For example, it is possible to dispose the receptacles in an insulating holder device. The element having the conducting connections that are combined in the insulating holder device can then be attached onto the conductor of one of parts 70, 81 and then the other part can be installed, so that the corresponding conductors of both parts 70, 81 can be electrically contacted with one another simultaneously with this assembly procedure.

It is obvious to the person skilled in the art that the invention is not limited to the exemplary embodiments described above, but rather can be varied in many ways, in particular also within the scope of the subject of the following claims. In this way also, in particular, the features of the embodiment examples may be combined with one another. Therefore, the embodiment examples shown in FIGS. 1 and 4 are presented in a greatly simplified manner, and the current connection apparatuses depicted therein, among other things, may also have tube-shaped insulating elements, such as they were described on the basis of FIG. 2, on one or both sides.

List of reference numbers:

Tank: 2
Neck flange: 3
Plug body: 5, 6
Lead: 7
Protective casing: 9
Gasket: 10, 11
Screw connection: 13
Pipe connection: 21
Connection cables: 22
Connection cables: 23
Receptacles: 50, 60
Openings: 52
Metal flange: 70
Insulating body: 72, 720
Conductors: 73, 730
Axial opening: 74
Boreholes: 75
Insulating elements: 76
Foot: 77
Plate: 78
Screw connection: 79
Sealing surface: 80
Two-part structure: 81
Intermediate space: 82
Double-sided receptacle: 83

What is claimed is:

1. A current connection apparatus of a tank, comprising:

a neck flange mounted on the tank, the neck flange having an opening into the tank;

electrical connection cables in the opening for connecting the tank to an external electrical apparatus;

an electrical lead having a metal flange, the metal flange having at least one opening sealed by an insulating body and having a plurality of conductors in the at least one opening, the plurality of conductors being electrically insulated relative to the metal flange;

a protective casing, the electrical lead being disposed between the neck flange and the protective casing and being tightly fastened to the neck flange;

a first plug body having a plurality of first plug elements corresponding in number to the plurality of conductors, the first plug body being in the opening of the neck flange so that, with the electrical lead attached to the neck flange, the electrical connection cables are electrically contacted with the plurality of conductors; and a second plug body having a plurality of second plug elements corresponding in number to the plurality of conductors, the second plug body being in the protective casing so that, with the protective casing attached to a second metal flange, the plurality of second plug elements are electrically contacted with the plurality of conductors; and wherein the plurality of first and second plug elements each comprises a receptacle, in which a respective conductor of the plurality of conductors engage.

2. The current connection apparatus according to claim 1, wherein the electrical lead has, at least on one side, a tube-shaped insulating element surrounding each of the plurality of conductors, the each of the tube-shaped insulating elements having an inner wall that is radially distanced from a respective conductor.

3. The current connection apparatus according to claim 2, wherein the first and second plurality of plug elements each comprise a receptacle, which engages in the tube-shaped insulating element and, in the state when contacted with the respective conductor, are surrounded by the tube-shaped insulating element.

4. The current connection apparatus according to claim 2, wherein at least one of the first and second plug bodies has a plurality of openings into which the tube-shaped insulating elements project.

5. The current connection apparatus according to claim 3, further comprising at least one spring element configured to press the tube-shaped insulating element onto a insulation body of the electrical lead.

6. The current connection apparatus according to claim 1, wherein the electrical lead is screwed together with the neck flange.

7. The current connection apparatus according to claim 1, wherein the plurality of conductors each have a diameter of at least five millimeters.

8. The current connection apparatus according to claim 1, wherein the electrical lead comprises two parts tightly joined in the axial direction, whereby each of the two parts has at least one insulating body and several conductors, whereby corresponding conductors of the two parts are electrically connected to one another.

9. The current connection apparatus according to claim 1, wherein the insulating body comprises a glass seal in the electrical lead.

10. The current connection apparatus according to claim 1, wherein the protective casing is tightly connected with the electrical lead.

11. The current connection apparatus according to claim 1, wherein the tank comprises a hazardous materials tank for combustible materials.

12. A method for producing a current connection apparatus according to claim 1, comprising prefabricating a subassembly having the electrical lead and the second plug body and attaching the subassembly to the first plug body.

13. A current connection apparatus of a tank, comprising:

an electrical lead having a metal flange, the metal flange having at least one opening sealed by an insulating body and having a plurality of conductors in the at least one opening, the plurality of conductors being electrically insulated relative to the metal flange;

a protective casing, the electrical lead being disposed between a neck flange and the protective casing and being tightly fastened to the neck flange;

and a plug body having a plurality of plug elements corresponding in number to the plurality of conductors, the plug body being in the protective casing so that, with the protective casing attached to a second metal flange, the plurality of plug elements are electrically contacted with the plurality of conductors; and wherein the plurality of plug elements each comprises a receptacle, in which a respective conductor of the plurality of conductors engage.

* * * * *